United States Patent [19]

Davidson et al.

[11] Patent Number: 4,926,948

[45] Date of Patent: May 22, 1990

[54] METHOD AND APPARATUS FOR CONTROLLING MOTORGRADER CROSS SLOPE CUT

[75] Inventors: James B. Davidson, New Carlisle; Peter N. Kaz, Medway; Michael H. Kidwell; Mark E. Zachman, both of Huber Heights, all of Ohio

[73] Assignee: Spectra Physics, Inc., San Jose, Calif.

[21] Appl. No.: 372,909

[22] Filed: Jun. 28, 1989

[51] Int. Cl.[5] ..... E02F 3/84

[52] U.S. Cl. ..... 172/4.5; 172/789; 172/1; 37/DIG. 20; 180/136

[58] Field of Search ..... 172/2, 4.5, 781, 789; 37/DIG. 1, DIG. 14, DIG. 20, 108 R; 180/136

[56] References Cited

U.S. PATENT DOCUMENTS

| | | | |
|---|---|---|---|
| 2,754,499 | 7/1956 | Jost | 340/431 |
| 2,886,299 | 5/1959 | Heimaster et al. | 340/690 X |
| 3,250,547 | 5/1966 | Myers | 280/432 |
| 3,786,871 | 1/1974 | Long et al. | 172/4.5 |
| 3,791,452 | 2/1974 | Long et al. | 172/4.5 |
| 3,833,928 | 9/1974 | Gairt et al. | 340/431 |
| 3,947,839 | 3/1976 | Zigmant | 340/431 |
| 4,008,466 | 2/1977 | Smith | 340/431 |
| 4,081,033 | 3/1978 | Bulger et al. | 172/4.5 |
| 4,122,390 | 10/1978 | Kollitz et al. | 340/431 X |
| 4,213,503 | 7/1980 | Elmberg et al. | 172/4.5 |
| 4,431,060 | 2/1984 | Scholl et al. | 172/4.5 |
| 4,465,292 | 8/1984 | Fry et al. | 280/95.1 |
| 4,545,439 | 10/1985 | Sellett et al. | 172/4.5 X |
| 4,696,486 | 9/1987 | Ruhter | 280/432 |

FOREIGN PATENT DOCUMENTS

| | | | |
|---|---|---|---|
| 3610666 | 10/1987 | Fed. Rep. of Germany | 37/DIG. 1 |
| 173232 | 10/1983 | Japan | 172/4.5 |
| 102023 | 6/1984 | Japan | 172/4.5 |

OTHER PUBLICATIONS

"Cat Automatic Blade Control" sales brochure, Caterpillar, Oct. 1979.

*Primary Examiner*—Randolph A. Reese
*Assistant Examiner*—Jeffrey L. Thompson
*Attorney, Agent, or Firm*—Killworth, Gottman, Hagan & Schaeff

[57] ABSTRACT

A method and apparatus are disclosed for controlling the cross slope angle cut by the blade of an articulated frame motorgrader operated in the crabbed steering mode wherein the articulation angle of the motorgrader frame is sensed and used to calculate the blade angle relative to horizontal required to maintain a desired cross slope angle. The blade angle is sensed and controlled such that the sensed blade angle is maintained substantially equal to the calculated blade angle. The blade angle calculation is performed using the equation:

$$\tan B = (\sin (A+R))(\tan L) + (\cos (A+R))(\tan C)$$

where B is the required blade slope angle of the blade relative to horizontal; A is the sensed angle of rotation of a steering unit relative to a drive unit, the steering unit and drive unit making up the motorgrader articulated frame; R is the sensed angle of rotation of the blade relative to the steering unit; L is the sensed direction of travel slope angle of the motorgrader; and, C is the desired cross slope angle which is entered by an operator of the motorgrader.

8 Claims, 3 Drawing Sheets

METHOD AND APPARATUS FOR CONTROLLING MOTORGRADER CROSS SLOPE CUT

BACKGROUND OF THE INVENTION

The present invention relates generally to a motorgrader having a two-part articulated frame defined by a rear drive unit and a front steering unit which can be rotated or pivoted relative to the drive unit and, more particularly, to an improved method and apparatus for controlling the cross slope angle cut by such a motorgrader while the motorgrader is being operated with the steering unit in a pivoted position relative to the drive unit.

It is important to be able to grade surfaces during the construction of roadbeds, runways, parking lots and the like so that the grade and cross slope closely approximate the finished surface. In this way, the pavement is of a uniform thickness and strength. Highly skilled motorgrader operators can perform grading operations manually to produce acceptable grades and cross slopes. However, due to time pressures and the limited number of highly skilled operators, automatic control systems have been developed to assist operators and reduce the time and skill required to obtain acceptable grading.

One such system permits a motorgrader operator to preset the slope of the blade and maintain that slope by servo valves or the like activated by a blade slope sensor. The blade slope sensor is mounted on the blade or a blade supporting structure. While these systems may be made to accurately reflect the blade slope relative to horizontal, they do not always reflect the true cross slope of the cut being made by the motorgrader, i.e. the slope normal to the direction of travel of the motorgrader. For example, errors occur when the blade is not positioned perpendicular to the direction of travel which is normally the case during operation when dirt is to be moved to one side or the other of the motorgrader.

To overcome these problems, a motorgrader control system was developed to account for the angular positioning of the blade relative to the direction of travel of the motorgrader and also the inclination or slope assumed by the motorgrader. An example of such a control system is disclosed in U.S. Pat. No. 3,786,871 and is a great improvement over the previously available slope preset system. Unfortunately, the disclosed system is not effective for all operating modes of motorgraders.

Most modern motorgraders have a two-part articulated frame defined by a rear drive unit and a front steering unit which can be rotated or pivoted relative to the drive unit. Oftentimes it is required or desireable to operate a motorgrader with the front steering unit articulated at an angle relative to the rear drive unit, for example to position the drive unit on firm ground. When a motorgrader is operated in an articulated position and travelling in the direction defined by and in-line with the rear drive unit, the operating position is referred to as a "crabbed" steering position due to the movement of the motorgrader in an indirect or diagonal manner as a crab moves. For crabbed steering, the disclosed control system is ineffective.

Accordingly, there is a need for an improved method and apparatus for operating a motorgrader having a two-part articulated frame to maintain a desired cross slope when the motorgrader is operated in a crabbed steering position.

SUMMARY OF THE INVENTION

This need is met by the method and apparatus of the present invention for controlling the cross slope angle cut by the blade of an articulated frame motorgrader wherein the articulation angle of the motorgrader frame is sensed and used in the calculation of the blade slope angle required to maintain a selected cross slope angle. The blade slope is then controlled so that the sensed blade slope angle is substantially equal to the calculated blade slope angle to maintain the desired cross slope even when the motorgrader is operated in a crabbed steering position. The articulation angle of the motorgrader may be sensed directly at a frame articulation joint or remotely at the steering wheels of the motorgrader.

In accordance with one aspect of the present invention, apparatus is provided for controlling the cross slope angle of a surface being worked by a motorgrader having a two-part articulated frame defined by a rear drive unit including rear drive wheels and a front steering unit which can be rotated relative to the drive unit and including front steering wheels. A blade is supported upon the steering unit for rotation about a generally vertical axis with the blade being mounted for adjustment of the elevations of its ends to define a blade slope angle relative to horizontal. The apparatus comprises input means for selecting a desired cross slope angle, first angle sensor means for sensing the angle of rotation of the blade relative to the steering unit, and second angle sensor means for sensing the angle of rotation of the steering unit relative to the drive unit. First slope sensor means sense the blade slope angle of the blade relative to horizontal and second slope sensor means sense the direction of travel slope angle of the motorgrader. Cross slope control means is connected to the input means, to the first and second angle sensor means, and to the first and second slope sensor means for controlling the blade slope angle to maintain the desired cross slope when the motorgrader is operated in a crabbed steering position.

The second angle sensor means may be mounted at an articulation joint interconnecting the steering unit to the drive unit of the motorgrader or adjacent and coupled to the front steering wheels of the motorgrader, as preferred for a given application. The blade slope angle required to maintain the desired cross slope may be calculated by the cross slope control means using the equation:

$$\tan B = (\sin (A+R))(\tan L) + (\cos (A+R))(\tan C)$$

where B is the required blade slope angle of the blade relative to horizontal; A is the angle of rotation of the steering unit relative to the drive unit; R is the angle of rotation of the blade relative to the steering unit; L is the direction of travel slope angle of the motorgrader; and C is the desired cross slope angle. The cross slope control means then controls the blade slope so that the sensed blade slope angle is substantially equal to the calculated blade slope angle to maintain the desired cross slope when the motorgrader is operated in a crabbed steering position.

In accordance with another aspect of the present invention, a method is provided for controlling the cross slope angle of a surface being worked by a motorgrader having a two-part articulated frame defined by a rear drive unit including rear drive wheels and a front steering unit which can be rotated relative to the drive unit and including front steering wheels. A blade is supported upon the steering unit for rotation about a generally vertical axis with the blade being mounted for adjustment of the elevations of its ends to define a blade slope angle relative to horizontal. The method for controlling the cross slope angle of a surface being worked by the motorgrader comprises the steps of: selecting a desired cross slope angle; sensing the angle of rotation of the blade relative to the steering unit; sensing the angle of rotation of the steering unit relative to the drive unit; sensing the blade slope angle of the blade relative to horizontal; sensing the direction of travel slope of the motor grader; and controlling the blade slope angle as a function of the desired cross slope angle, the blade rotation angle, the steering unit rotation angle, and the motorgrader direction of travel slope angle to maintain the desired cross slope when the motorgrader is operated in a crabbed steering position.

The step of controlling the blade slope angle as a function of the desired cross slope angle, the blade rotation angle, the steering unit rotation angle, and the motorgrader direction of travel slope angle may comprise the steps of: calculating a blade slope angle required for a desired cross slope using the equation:

$$\tan B=(\sin (A+R))(\tan L)+(\cos (A+R))(\tan C)$$

where B is the required blade slope angle of the blade relative to horizontal; A is the angle of rotation of the steering unit relative to the drive unit; R is the angle of rotation of the blade relative to the steering unit; L is the direction of travel slope angle of the motorgrader; and, C is the desired cross slope angle, and controlling the blade slope so that the sensed blade slope angle is substantially equal to the calculated blade slope angle to maintain the desired cross slope when the motorgrader is operated in a crabbed steering position. The step of sensing the angle of rotation of the steering unit relative to the drive unit may comprise the step of installing an angle sensor at an articulation joint interconnecting the steering unit to the drive unit or the step of installing an angle sensor adjacent and coupled to the front steering wheels, as preferred for a given application.

It is thus an object of the present invention to provide an improved method and apparatus for controlling the cross slope angle cut by the blade of an articulated frame motorgrader which is effective while the motorgrader is operated in a crabbed steering position; to provide an improved method and apparatus for controlling the cross slope angle cut by the blade of an articulated frame motorgrader by sensing the articulation angle of the motorgrader frame, using the sensed articulation angle to calculate the blade slope angle required to maintain a selected cross slope angle and controlling the blade slope so that the sensed blade slope angle is substantially equal to the calculated blade slope angle; and, to provide an improved method and apparatus for controlling the cross slope angle cut by the blade of an articulated frame motorgrader by sensing the articulation angle of the motorgrader frame at or near an articulation joint or the front steering wheels which also reflect the articulation angle, using the sensed articulation angle to calculate the blade slope angle required to maintain a selected cross slope angle, and controlling the blade slope so that the sensed blade slope angle is substantially equal to the calculated blade slope angle.

Other objects and advantages of the invention will be apparent from the following description, the accompanying drawings and the appended claims.

DETAILED DESCRIPTION OF THE INVENTION

Figure 2:
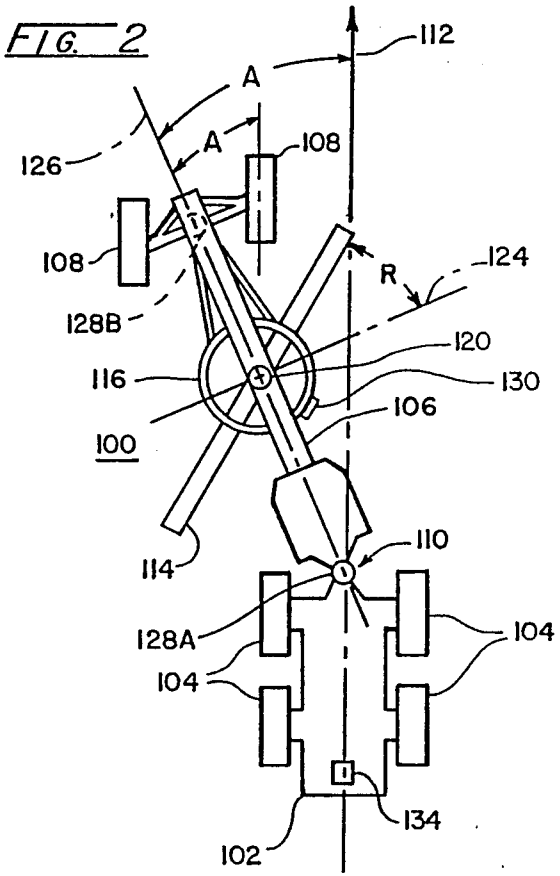
FIGS. 1 and 2 are schematic plan views of articulated frame motorgraders illustrating straight frame operation and articulated frame operation, respectively.
Figure 1:
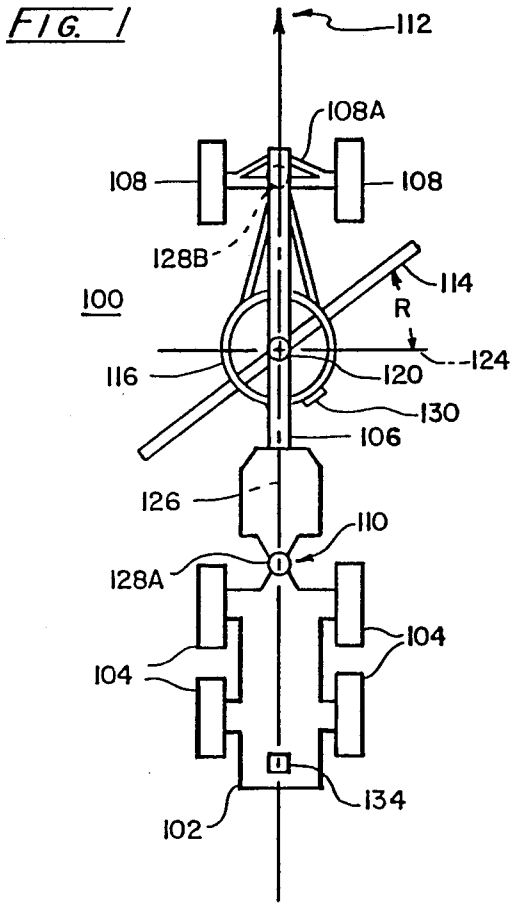

Reference is now made to the drawing figures wherein FIGS. 1 and 2 schematically illustrate a two-part articulated frame motorgrader 100 in plan view. The motorgrader 100 includes a rear drive unit 102 including rear drive wheels 104 and a front steering unit 106 including front steering wheels 108. The front steering unit 106 is connected to the rear drive unit 102 by a frame articulation joint 110 so that the steering unit 106 can be rotated relative to the drive unit 102 to assist the steering wheels 108 in steering the motorgrader 100 and to permit "crabbed" steering of the motorgrader 100 as shown in FIG. 2. While straight frame operation as shown in FIG. 1 is used much of the time, it is often desireable to operate the motorgrader 100 with the steering unit 106 rotated at a selectable angle A relative to the drive unit 102, but traveling in a direction 112 defined by and in-line with the drive unit 102, which is referred to as crabbed steering.

A blade 114 is supported upon the steering unit 106 by means of a draw bar/turntable arrangement commonly referred to as a "ring" or "circle" 116 so that the blade 114 can be rotated about a generally vertical axis collinear with the center of the circle 116. When the motorgrader 100 is operated in the straight frame orientation of FIG. 1, the control system of U.S. Pat. No. 3,786,871, which is incorporated herein by reference, or an equivalent system is capable of maintaining a desired cross slope, i.e. the slope normal to the direction of travel of the motorgrader 100, for the cut being made by the motorgrader 100. Unfortunately, when the motorgrader 100 is operated in the articulated frame orientation of FIG. 2 or crabbed steering mode, such control systems are ineffective and an operator must again resort to manual control of the grading operation.

In accordance with the present invention, a method and apparatus are provided to control the cross slope of the cut being made by the motorgrader 100 even when the motorgrader 100 is operated in a crabbed steering postion. The apparatus required for operation of the present invention includes input means comprising an input device 118, see FIG. 3, such as a keyboard or the like, for selecting a desired cross slope angle C. The input device 118 is typically mounted in the operator's cab (not shown) for the motorgrader 100. First angle sensor means comprising an angle sensor 120 senses the angle of rotation R of the blade 114 relative to the steering unit 106. As shown in the drawing figures the blade angle of rotation R is measured relative to a line 124 perpendicular to the axis 126 of the steering unit 106 so that a zero degree blade rotation angle corresponds to positioning the blade 114 perpendicular to the steering unit 106. Further, for proper operation of the present invention, the circle 116 must remain centered relative to the steering unit 106 and not be side-shifted.

Second angle sensor means comprising an angle sensor 128A or 128B senses the angle of rotation A of the steering unit 106 relative to the drive unit 102. The angle sensor 128A is mounted at or near the articulation joint 110 interconnecting the steering unit 106 to the drive unit 102 so that the rotation angle A is directly sensed while the sensor 128B, which is mounted adjacent and coupled to the front steering wheels 108, senses the rotation angle A indirectly, see FIG. 2. As shown in FIGS. 1 and 2, the sensor 128B is mounted generally between the front steering wheels 108 and coupled thereto for example by steering linkages 108A. Of course, the sensor 128B could be positioned directly adjacent to one of the front steering wheels 108 to more directly sense the rotation angle A, if desired. The angle sensors 120, 128A and 128B may comprise, among other devices, an angle encoder commercially available from BEI Motion Systems Company of Goletta, Calif. for example.

Figure 3:
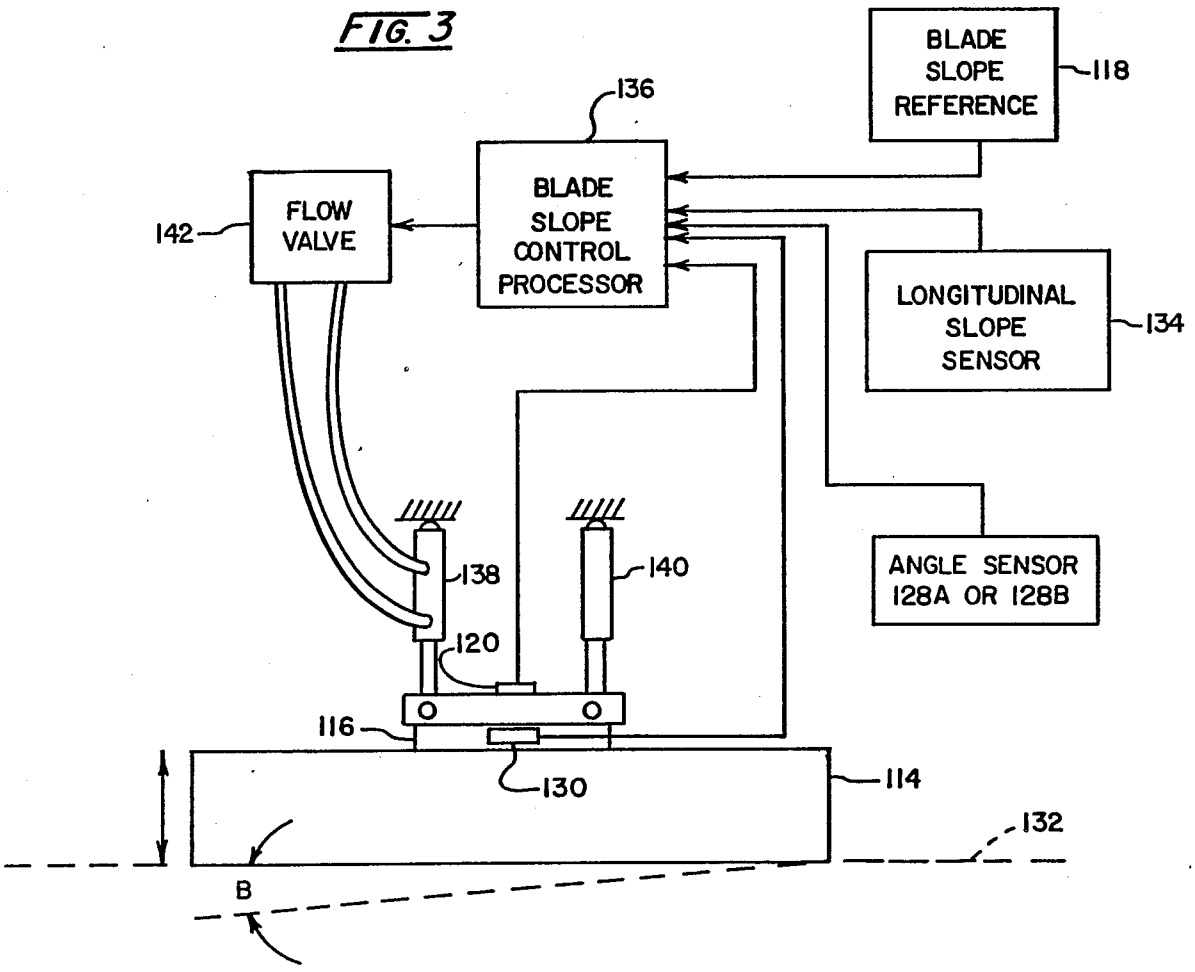
FIG. 3 is a schematic block diagram showing the application of the present invention for cross slope control in a motorgrader.
Figure 4:
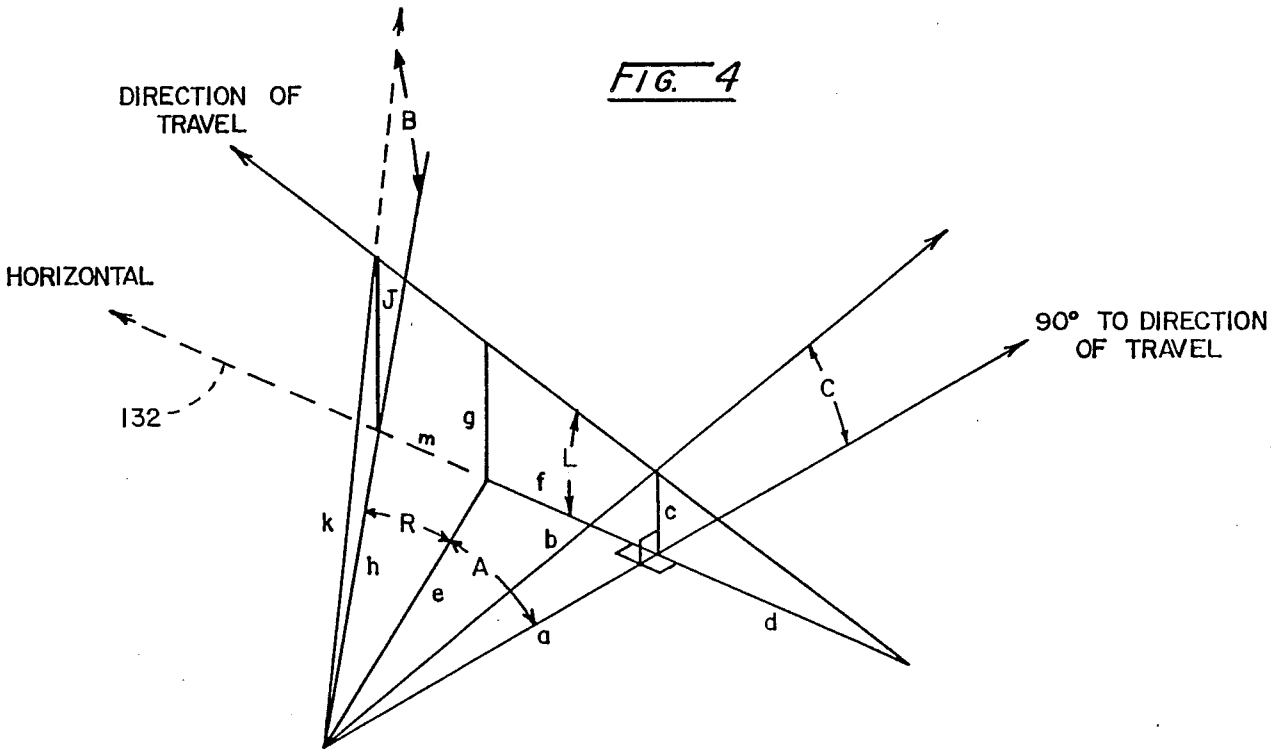
FIG. 4 is a line drawing illustrating motorgrader movement and relative orientations of components of a motorgrader for articulated frame, crabbed steering operation.

First slope sensor means comprising a slope sensor 130 senses the blade slope angle B of the blade 114 relative to horizontal 132, see FIGS. 3 and 4. As shown, the slope sensor 130 is mounted on the ring 116; however, it can be mounted on the blade 114 or other blade supporting structure as preferred for a given application. Second slope sensor means comprising a slope sensor 134 mounted on the rear drive unit 102 senses the direction of travel slope angle L of the motorgrader 100. Finally, cross slope control means comprising a blade slope control processor 136 in the illustrated embodiment is connected and responsive to the input device 118, to the angle sensors 120 and 128A or 128B, and to the first and second slope sensors 130 and 134 to control the blade slope angle B to maintain the desired cross slope angle C even when the motorgrader 100 is operated in a crabbed steering orientation as shown in FIG. 2. The first and second slope sensors 130 and 134 can comprise, among other available devices, fluid filled vials which form electrolytic potentiometers for monitoring the blade slope angle and the travel slope angle, respectively.

It is noted that the rotation angle A of the steering unit 106 relative to the drive unit 102 and the angle of rotation R of the blade 114 are not measured in the horizontal plane unless the blade slope angle B and the direction of travel slope angle L are both equal to zero. Since, the blade slope angle B and/or the direction of travel slope angle L are oftentimes not equal to zero, the rotation angles A and R thus include a slight-error as compared to the angles A and R measured in the horizontal plane. While the errors could be corrected or compensated for in the present invention, the effects of the errors are neglible and therefore are ignored and will not be referred to further herein.

In FIG. 3, a blade cross slope control system operable in accordance with the present invention for the grader blade 114 of the motorgrader 100 is shown in schematic block diagram form from a rear view of the grader blade 114. The elevation of the ring 116 and hence the elevation of the blade 114 is controlled by a pair of hydraulic cylinders 138 and 140 which are well known and hence only shown schematically in the block diagram of FIG. 3. The blade slope control processor 136 controls the cylinder 138 via a flow valve 142 with the cylinder 140 being controlled by an operator of the motorgrader 100 or an elevation positioning device (not shown), such as a laser control system or a string line control system, which is well known in the art and hence not described herein. It should be apparent that other earthworking tools in addition to a grader blade can be mounted in a variety of ways such that the blade or other tool is supported by a pair of hydraulic cylinders, such as the cylinders 138 and 140, which control both the elevation and slope of the blade or other tool. The present invention is equally applicable for controlling the cross slope of such tools as should be apparent from the present disclosure.

An equation will now be developed for the operation of the blade slope control processor 136 of FIG. 3 with reference to FIG. 4 which is a line drawing illustrating motorgrader movement and the relative positioning of components of a motorgrader operating in an articulated frame orientation or a crabbed steering mode. The following angular orientations are monitored or controlled by the slope control processor 136: B—the required blade slope angle of the blade 114 relative to horizontal; A—the angle of rotation of the steering unit 106 relative to the drive unit 102; R—the angle of rotation of the blade 114 relative to the steering unit 106; L—the direction of travel slope angle of the motorgrader 100; and, C—the desired cross slope angle as selected by the operator using the blade slope reference 118. The line segment designations are relative and utilized only to derive equation (a) as should be apparent.

$$\tan B = \textit{blade slope angle (rise/run)} = j/h$$

$$\tan L = \textit{travel slope angle (rise/run)} = (j-c)/(m+f)$$

$$\tan C = \textit{cross slope} = c/a$$

$$h = SQRT((m+f)^2 + a^2)$$

$$j = (m+f)\tan L + c$$

$$\tan B = ((m+f)\tan L + c)/SQRT((m+f)^2 + a^2)$$

$$\tan B = a\tan(A+R)(\tan L) + a(\tan C)/SQRT((a\tan(A+R))^2 + a^2)$$

$$\tan B = \tan(A+R)(\tan L) + \tan C/SQRT(\tan^2(A+R)+1)$$

$$\cos(A+R) - 1/SQRT(\tan^2(A+R)+1)$$

$$\tan B = (\cos(A+R))(\tan(A+R))(\tan L) + (\cos(A+R))(\tan C)$$

$$\tan B = (\sin(A+R))(\tan L) + (\cos(A+R))(\tan C) \qquad \text{(a)}$$

where B is the required blade slope angle of the blade relative to horizontal; A is the angle of rotation of the steering unit relative to the drive unit; R is the angle of rotation of the blade relative to the steering unit; L is the direction of travel slope angle of the motorgrader; and C is the desired cross slope angle. Equation (a) is utilized by the blade slope control processor 136 to determine the blade slope angle B required to maintain the desired cross slope for a cut being performed by the motorgrader 100. The cross slope control means or blade slope control processor 136 then controls the blade slope via the flow valve 142 and the cylinder 138 so that the sensed blade slope angle B is maintained substantially equal to the calculated blade slope angle B to maintain the desired cross slope angle C even when the motorgrader 100 is operated in a crabbed steering position as shown in FIG. 2. It is noted that the blade slope control processor 136 also functions properly to maintain the cross slope angle C when the motorgrader 100 is operated in a straight frame mode since for such operation A=0 and it can be seen that the equation for B is still accurate.

While the method of operating the disclosed apparatus should be apparent from the foregoing description, a brief description will now be provided for the sake of clarity. The method for controlling the cross slope angle of a surface being worked by the motorgrader 100 comprises the steps of: selecting a desired cross slope angle C; sensing the angle of rotation R of the blade 114 relative to the steering unit 106; sensing the angle of rotation A of the steering unit 106 relative to the drive unit 102; sensing the blade slope angle B of the blade 114 relative to horizontal 132; sensing the direction of travel slope L of the motor grader 100; and controlling the blade slope angle B as a function of the desired cross slope angle C, the blade rotation angle R, the steering unit rotation angle A, and the motorgrader direction of travel slope angle L to maintain the desired cross slope C when the motorgrader 100 is operated in a crabbed steering position.

The step of controlling the blade slope angle as a function of the desired cross slope angle C, the blade rotation angle R, the steering unit rotation angle A, and the motorgrader 100 direction of travel slope angle L may comprise the steps of: calculating a blade slope angle B required for a desired cross slope C using the equation:

$$\tan B=(\sin (A+R))(\tan L)+(\cos (A+R))(\tan C)$$

where B is the required blade slope angle of the blade 114 relative to horizontal 132; A is the angle of rotation of the steering unit 106 relative to the drive unit 102; R is the angle of rotation of the blade 114 relative to the steering unit 106; L is the direction of travel slope angle of the motorgrader 100; and, C is the desired cross slope angle, and controlling the blade slope so that the sensed blade slope angle B is substantially equal to the calculated blade slope angle B to maintain the desired cross slope C when the motorgrader 100 is operated in a crabbed steering position.

The step of sensing the angle of rotation R of the steering unit 106 relative to the drive unit 102 may comprise the step of installing an angle sensor 128A at an articulation joint 110 interconnecting the steering unit 106 to the drive unit 102 or the step of installing an angle sensor 128B adjacent and coupled to the front steering wheels 108, as preferred for a given application.

Having thus described the method and apparatus for controlling motorgrader cross slope cut of the present invention in detail and by reference to preferred embodiments thereof, it will be apparent that modifications and variations are possible without departing from the scope of the invention defined in the appended claims.

What is claimed is:

1. In a motorgrader having a two-part articulated frame defined by a rear drive unit including rear drive wheels and a front steering unit which can be rotated relative to the drive unit and including front steering wheels, and a blade supported upon the steering unit, the blade being rotatable about a generally vertical axis and being mounted for adjustment of the elevations of the ends of the blade to define a blade slope angle relative to horizontal, apparatus for controlling the cross slope angle of a surface being worked by the motorgrader comprising:

input means for selecting a desired cross slope angle;

first angle sensor means for sensing the angle of rotation of the blade relative to the steering unit;

second angle sensor means for sensing the angle of rotation of said steering unit relative to the drive unit;

first slope sensor means for sensing the blade slope angle of said blade relative to horizontal;

second slope sensor means for sensing the direction of travel slope angle of said motorgrader; and cross slope control means connected to said input means, to said first and second angle sensor means, and to said first and second slope sensor means for controlling said blade slope angle to maintain said desired cross slope when said motorgrader is operated in a crabbed steering position.

2. Apparatus for controlling the cross slope of a surface being worked by a motorgrader as claimed in claim 1 wherein said second angle sensor means is mounted at an articulation joint interconnecting said steering unit to said drive unit.

3. Apparatus for controlling the cross slope of a surface being worked by a motorgrader as claimed in claim 1 wherein said second angle sensor means is mounted adjacent and coupled to said front steering wheels.

4. Apparatus for controlling the cross slope of a surface being worked by a motorgrader as claimed in claim 1 wherein the blade slope angle required to maintain the desired cross slope is calculated by said cross slope control means using the equation:

$$\tan B=(\sin (A+R))(\tan L)+(\cos (A+R))(\tan C)$$

where B is the required blade slope angle of said blade relative to horizontal; A is the angle of rotation of said steering unit relative to said drive unit; R is the angle of rotation of said blade relative to said steering unit; L is the direction of travel slope angle of said motorgrader; and C is the desired cross slope angle, and said cross slope control means controls said blade slope so that the sensed blade slope angle is substantially equal to the calculated blade slope angle to maintain said desired cross slope when said motorgrader is operated in a crabbed steering position.

5. In a motorgrader having a two-part articulated frame defined by a rear drive unit including rear drive wheels and a front steering unit which can be rotated relative to the drive unit and including front steering wheels, and a blade supported upon the steering unit, the blade being rotatable about a generally vertical axis and being mounted for adjustment of the elevations of the ends of the blade to define a blade slope angle relative to horizontal, a method for controlling the cross slope angle of a surface being worked by the motorgrader comprising the steps of:

selecting a desired cross slope angle;

sensing the angle of rotation of the blade relative to the steering unit;

sensing the angle of rotation of said steering unit relative to the drive unit;

sensing the blade slope angle of said blade relative to horizontal;

sensing the direction of travel slope of said motorgrader; and controlling said blade slope angle as a function of the desired cross slope angle, the blade rotation angle, the steering unit rotation angle, and the motorgrader direction of travel slope angle to maintain said desired cross slope when said motorgrader is operated in a crabbed steering position.

6. A method for controlling the cross slope angle of a surface being worked by a motorgrader as claimed in claim 5 wherein the step of controlling said blade slope angle as a function of the desired cross slope angle, the blade rotation angle, the steering unit rotation angle, and the motorgrader direction of travel slope angle comprises the steps of calculating a required blade slope angle using the equation:

$$\tan B=(\sin(A+R))(\tan L)+(\cos(A+R))(\tan C)$$

where B is the required blade slope angle of said blade relative to horizontal; A is the angle of rotation of said steering unit relative to said drive unit; R is the angle of rotation of said blade relative to said steering unit; L is the direction of travel slope angle of said motorgrader; and, C is the desired cross slope angle, and controlling the blade slope so that the sensed blade slope angle is substantially equal to the calculated blade slope angle to maintain said desired cross slope when said motorgrader is operated in a crabbed steering position.

7. A method for controlling the cross slope angle of a surface being worked by a motorgrader as claimed in claim 5 wherein the step of sensing the angle of rotation of said steering unit relative to said drive unit comprises the step of installing an angle sensor at an articulation joint interconnecting said steering unit to said drive unit.

8. A method for controlling the cross slope angle of a surface being worked by a motorgrader as claimed in claim 5 wherein the step of sensing the angle of rotation of said steering unit relative to said drive unit comprises the step of installing an angle sensor adjacent and coupled to said front steering wheels.

* * * * *